US005601471A

United States Patent [19]

Kennedy

[11] Patent Number: 5,601,471

[45] Date of Patent: Feb. 11, 1997

[54] SKATING DOLL PLATFORM

[76] Inventor: Melvin Kennedy, 825 Marbella La., Lantana, Fla. 33462

[21] Appl. No.: 559,418

[22] Filed: Nov. 15, 1995

[51] Int. Cl.[6] ..... A63H 1/00; A63H 3/00; A63H 13/02

[52] U.S. Cl. ..... 446/236; 446/268; 446/330; 446/333; 446/366

[58] Field of Search ..... 446/236, 237, 446/238, 268, 275, 279, 280, 281, 286, 287, 288, 308, 309, 330, 331, 333, 352, 359, 366, 367

[56] References Cited

U.S. PATENT DOCUMENTS

| | | | |
|---|---|---|---|
| 1,188,864 | 6/1916 | Webber | 446/366 |
| 1,323,669 | 12/1919 | Allstatter | 446/366 |
| 2,715,793 | 8/1955 | Strauss | 446/237 |
| 3,020,674 | 2/1962 | Sachs | 446/366 |
| 3,675,362 | 7/1972 | de Gelder et al. | 446/366 X |
| 4,186,516 | 2/1980 | Ensmann | 446/238 |
| 4,939,944 | 7/1990 | Hou | 446/330 X |
| 5,458,523 | 10/1995 | Aoki et al. | 446/333 X |

FOREIGN PATENT DOCUMENTS

| | | | |
|---|---|---|---|
| 507535 | 6/1939 | United Kingdom | 446/23 |

*Primary Examiner*—Robert A. Hafer
*Assistant Examiner*—D. Neal Muir
*Attorney, Agent, or Firm*—Michael Ebert

[57] ABSTRACT

A platform on which is mountable a doll resembling a figure skater, the platform serving as a stage simulating a skating rink. Housed within the platform in a finger-actuated mechanism operatively coupled to the lower end of a shaft extending through an upright bearing anchored on the stage. The upper end of the shaft which is slidable in the bearing is clamped to one leg of the doll to support it above the stage. When the mechanism is actuated by a finger on one hand of the player, it then causes the shaft to rotate and thereby spin the doll. When the mechanism is actuated by a finger of the other hand, it then acts to raise the shaft and thereby lifts the doll above the stage. The player, therefore, by concurrently causing the figure skating doll to spin and lift, simulates a figure skating movement.

7 Claims, 4 Drawing Sheets

FIG. 3
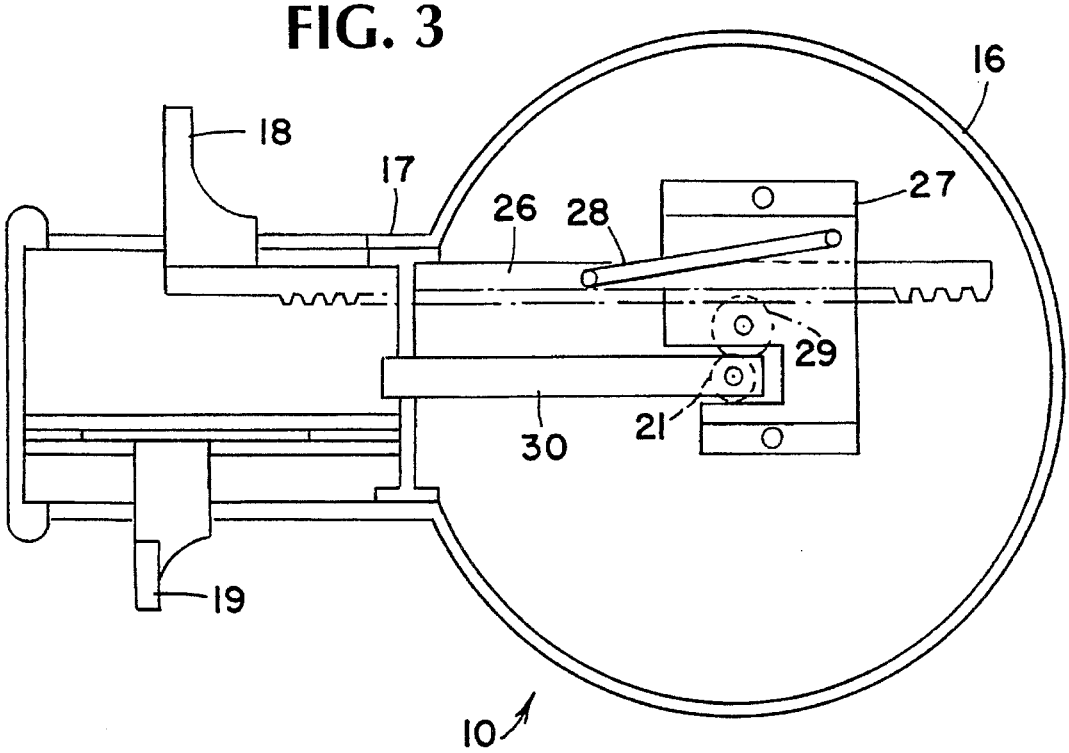
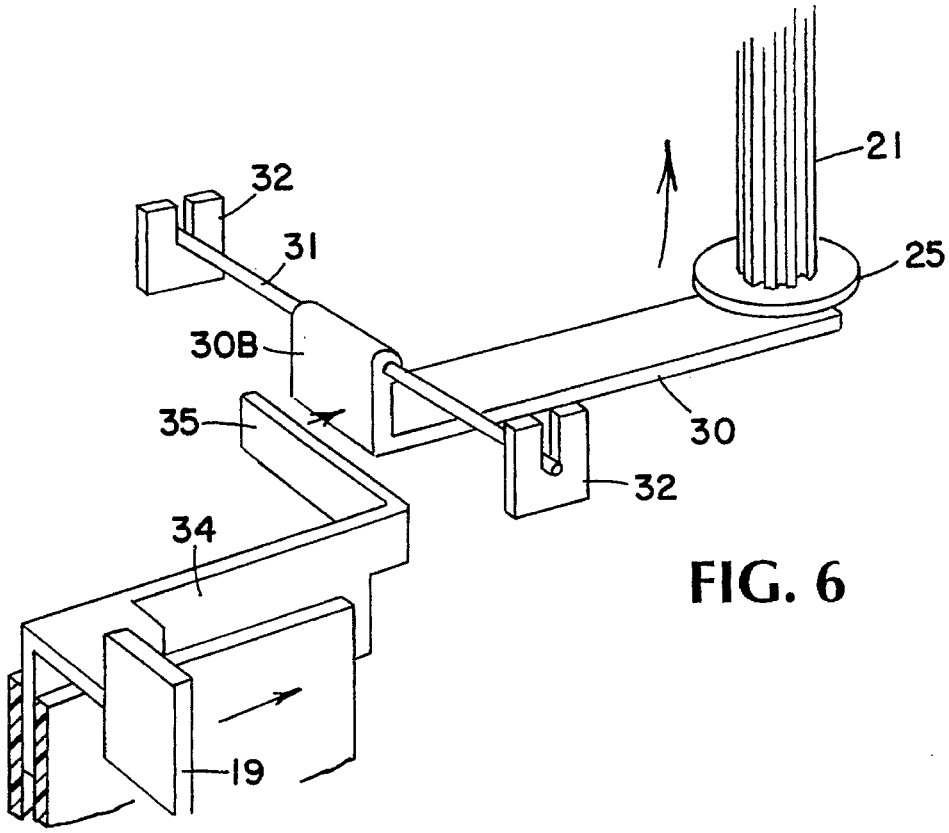
FIG. 6

SKATING DOLL PLATFORM

BACKGROUND OF INVENTION

1. Field of Invention

This invention relates generally to devices for animating a doll, and in particular to a platform on whose stage is mounted a doll resembling a figure skater, the platform housing a finger-actuated mechanism causing the doll to spin and be lifted above the stage to execute a figure skating movement.

2. Status of Prior Art

A typical doll is a small figure resembling a human being, such as an infant, a child or an adult which may be of either sex. The doll is surely the most popular of all toys and it can trace its history back to ancient times, for Egypt, Rome and Greece have left well preserved dolls of clay and other durable materials.

Doll technology is now highly sophisticated, for dolls are now available that are articulated, bendable and stretchable and can be caused to assume any desired posture.

An activity that holds great fascination for children is dancing, and children therefore seek to make their otherwise inanimate doll appear to be dancing. To render a doll danceable, the Jupiter patent 2,754,121 provides a large doll whose size approaches that of a small child, the doll having articulated arms and legs and a pair of feet provided with straps to receive the feet of a child dancing with the doll.

In Jupiter, the doll and child together form a ballroom couple, one hand of the child holding the corresponding hand of the doll, the other hand of the child holding the doll about its waist while the other hand of the doll rests on the shoulder of the child. Since the feet of the doll are linked to those of the child, and the child and doll are holding each other, the child and doll then appear to be dancing as a couple.

The present invention also seeks to make a doll dance, but not by having the child dance with the doll as in the Jupiter patent, for then the doll's size must be close to that of the child holding it, but by having the doll dance on a platform or stage.

A form of dancing that in recent years has become highly popular is figure skating in which a skater dances on an ice rink to music and executes balletic movements and creates new ones involving spins, lifts and jumps. One dramatic figure skating movement that takes skill to execute is where the skater spins on the ice and then leaps upwardly so as to spin in the air, the skater then landing on the ice without a loss of balance.

For a toy to be most effective as a plaything, it must be capable of sustaining a child's interest and to this end the behavior of the toy should depend on how it is manipulated by the child. Thus the Gunther et al. U.S. Pat. No. 3,643,374 discloses a platform on which a doll is mounted, the platform having a battery powered motor mechanism to animate the doll. Such devices have little play value, for there is no interaction between the player who simply switches on the mechanism to operate the doll.

In the Kimodo U.S. Pat. No. 4,674,988, a doll mounted above a platform is caused to twirl to simulate dancing. For this purpose, use is made of a thumb-operated flywheel operatively coupled to the doll. In the Kimura U.S. Pat. No. 4,040,206 the doll is turned about an axle rotated by a hand-cranked mechanism.

SUMMARY OF INVENTION

In view of the foregoing, the main object of the invention is to provide a platform serving as a stage for a doll resembling a figure skater, the platform housing a finger-actuated mechanism for causing the doll to execute a figure skating movement.

More particularly, an object of this invention is to provide a platform of the above type in which when the mechanism is actuated by a finger on one hand of a player then causes the doll to spin, and when actuated by a finger of the other hand, then causes the doll to lift above the stage.

Also an object of this invention is to provide a platform of the above type which operates efficiently and reliably, and which can be mass produced at low cost.

Briefly stated, these objects are attained by a platform on which is mountable a doll resembling a figure skater, the platform serving as a stage simulating a skating rink. Housed within the platform in a finger-actuated mechanism operatively coupled to the lower end of a shaft extending through an upright bearing anchored on the stage. The upper end of the shaft which is slidable in the bearing is clamped to one leg of the doll to support it above the stage.

When the mechanism is actuated by a finger on one hand of the player, it then causes the shaft to rotate and thereby spin the doll. When the mechanism is actuated by a finger of the other hand, it then acts to raise the shaft and thereby lifts the doll above the stage. The player, therefore, by concurrently causing the figure skating doll to spin and lift, simulates a figure skating movement.

BRIEF DESCRIPTION OF INVENTION

For a better understanding of the invention as well as other objects and further features thereof, reference is made to the following detailed description to be read in conjunction with the accompanying drawings, wherein:

FIG. 3 is a plan view of the mechanism housed in the doll;

FIG. 6 illustrates a portion of the mechanism.

DESCRIPTION OF INVENTION

Figure 1:
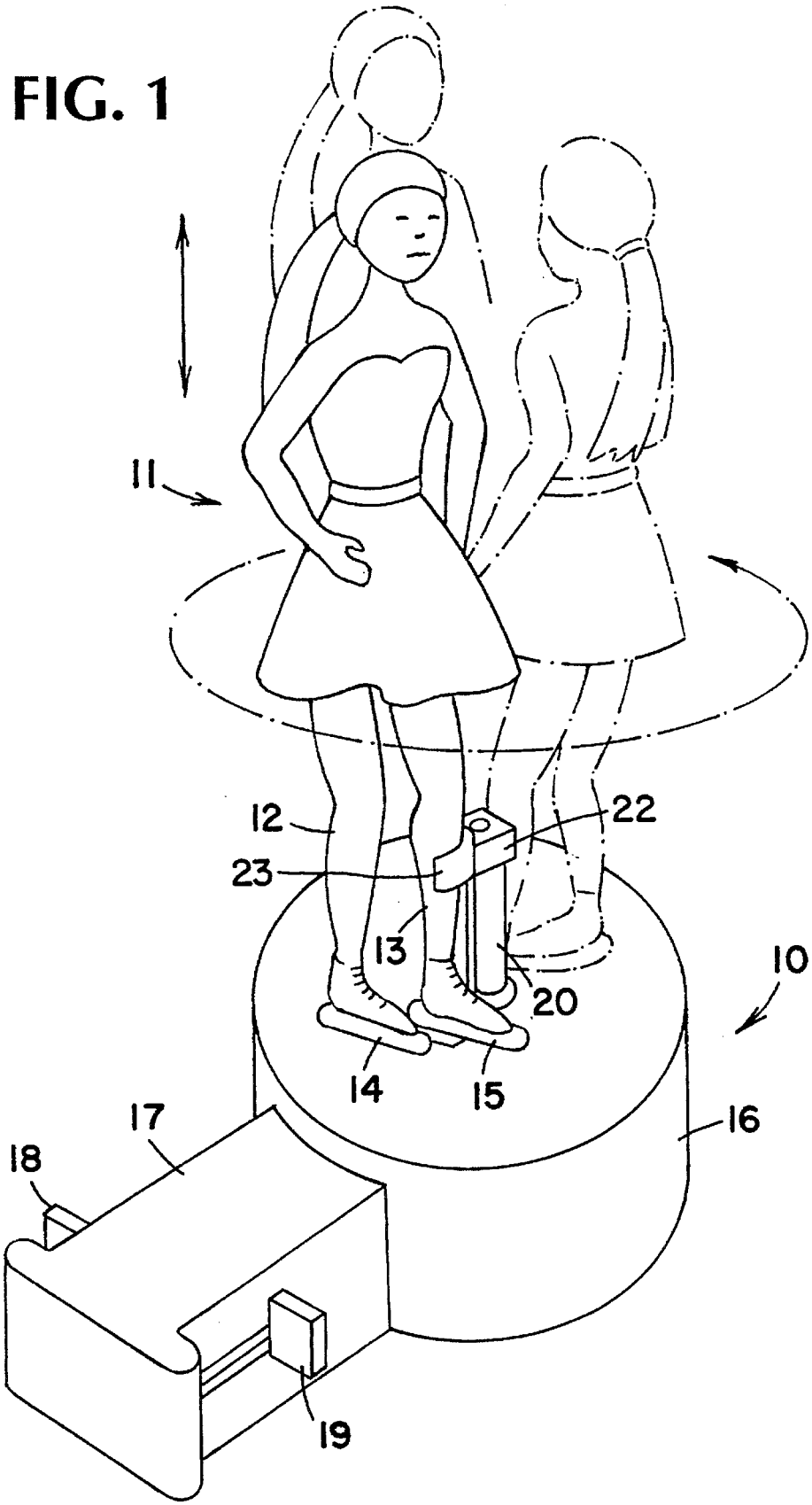
FIG. 1 illustrates, in perspective, a platform in accordance with the invention in which is mountable a doll resembling a figure skater.
Figure 2:
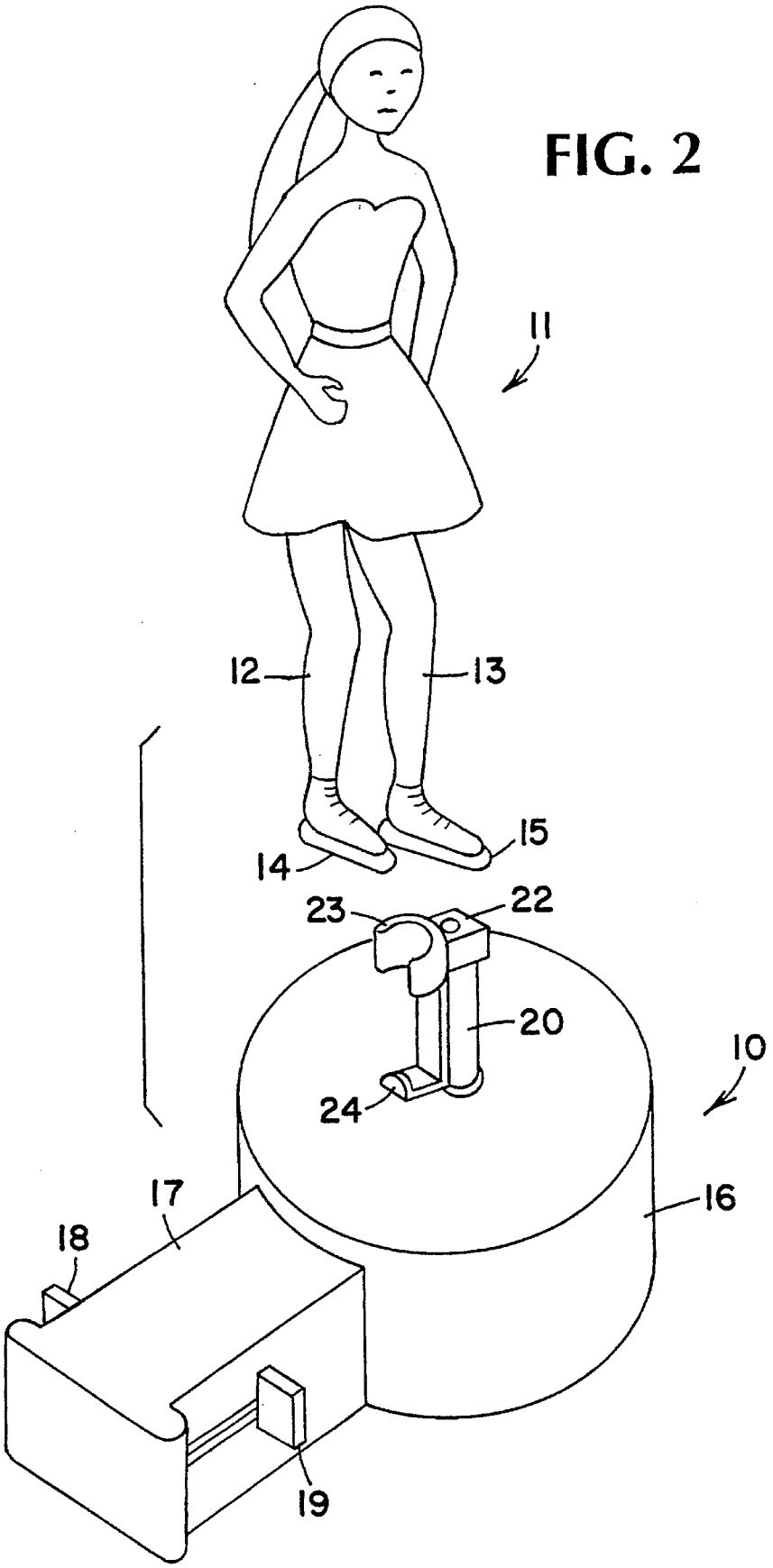
FIG. 2 shows the manner in which the doll is mounted.

Referring now to FIGS. 1 and 2, there is shown in these figures a platform in accordance with the invention, generally designated by numeral 10 on which is mountable a doll, generally identified by numeral 11. This doll resembles a girl dressed as a figure skater, the doll having a pair of bendable legs 12 and 13 on whose feet are fitted simulated ice skates 14 and 15.

Platform 10 serves as a stage for the doll and simulates an ice rink. The platform is formed by a drum-like section 16 having a box-like section 17 extending from one side of section 16.

Slidable along the opposing sides of section 17 are finger pieces 18 and 19 which when shifted then actuate respective sections of an internal mechanism to cause the doll to spin and lift above the stage to execute a figure skating movement.

Figure 4:
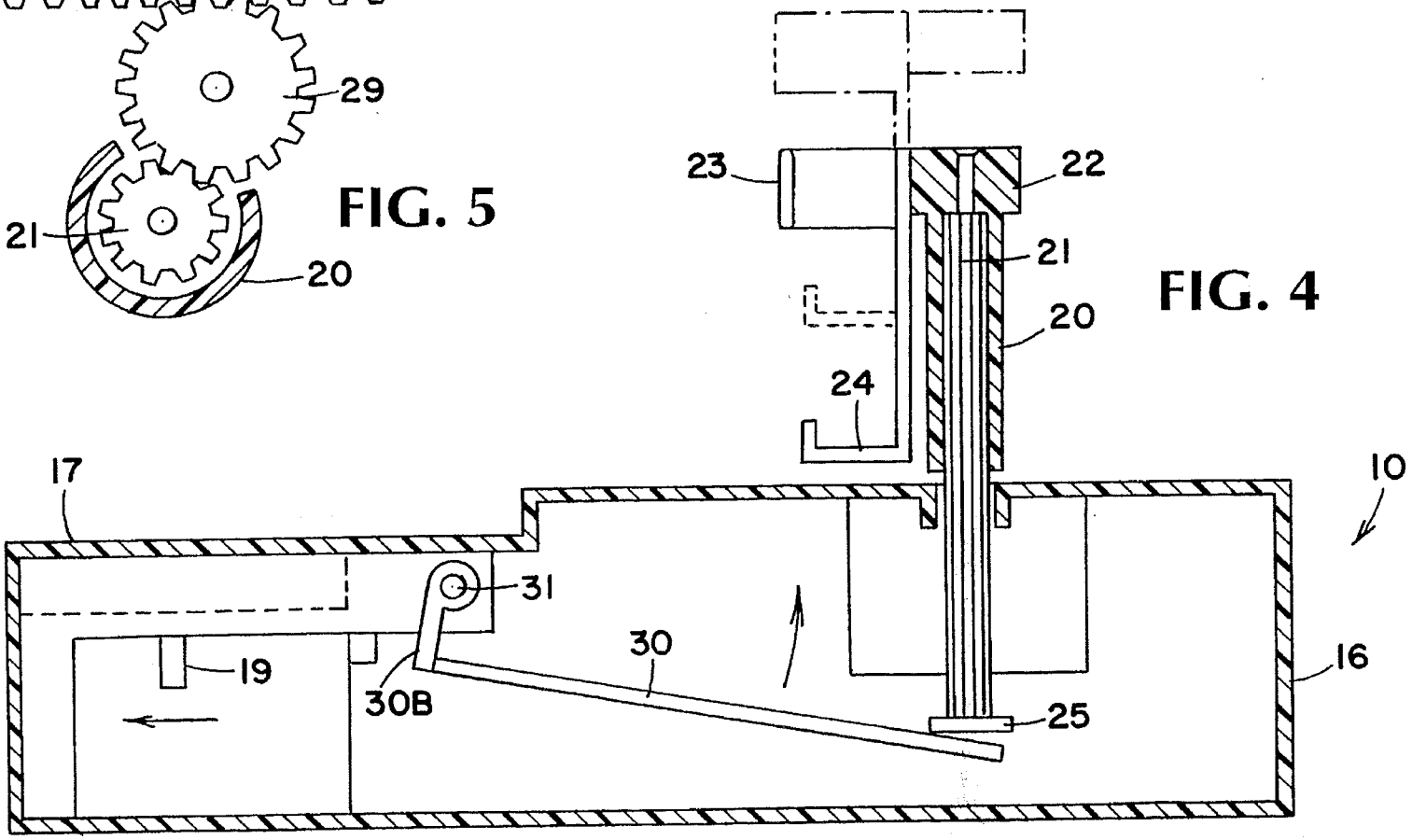
FIG. 4 is a section taken through the mechanism.

As best seen in FIGS. 1, 2 and 4, anchored on the center of the cylindrical platform section 16 is an upright bearing 20 within which is received a pinion or spline shaft 21. The upper end of shaft 21 projects above bearing 20 and is joined to a hub 22. Attached to one side of hub 22 is a split-shell clamp 23 formed by a pair of resilient jaws, and a foot rest 24 depending from the clamp.

As shown in FIGS. 1 and 2, doll 11 is mounted above the stage of platform 10 by having clamp 23 engage leg 13 of the doll, with the skate 15 on the foot then resting on foot rest 24 so that the doll is now firmly secured. In this way, the doll is supported above the ice skating stage.

The lower end of pinion shaft 21 projects into the interior of platform section 16 and terminates in a circular knob 25. Pinion shaft 21 is slidable in bearing 20 as well as being rotatable therein so that as the shaft rotates, it can at the same time be axially shifted in either direction. As best seen in FIG. 3, finger piece 18 is attached to one end of a rack 26 that is shiftable in a straight line with respect to a frame 27. A rubber band 28 connected between the rack and the frame serves to urge the rack toward the right.

Figure 5:
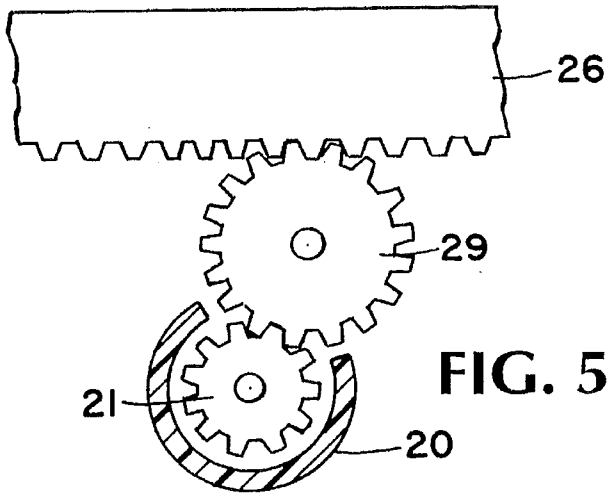
FIG. 5 shows a set of gears included in the mechanism.

When a player with the finger of one hand pulls finger piece 18 toward the left and thereby stretches the rubber band, the teeth of the rack then engage an intermediate gear 29 which as shown in FIGS. 3 and 5 intermeshes with pinion shaft 21. As a consequence of this action, pinion shaft 21 rotates and causes the doll clamped thereto to spin. Thus the mechanism includes a finger-actuated spin section.

The lift section of the internal mechanism is actuated by finger piece 19 which as best seen in FIG. 6 operates a lever 30 having an elbow 30B, the lever being swingable on an axle 31 mounted on trunnions. Finger piece is joined to a slide 34 having at its front end a bent foot 35 which when the finger piece is advanced toward the right, then engages the elbow 30B of lever 30 to cause the lever to swing upward and in doing so to raise the pinion shaft 21 and lift the doll above the stage.

Operation

A player uses one finger on each of his hands to actuate the spin and lift sections of the internal platform mechanism. When the player with a finger of one hand pulls finger piece 18, he then causes the pinion shaft 21 to rotate and thereby spin the doll clamped to the shaft. When the player with a finger of his other hand pulls finger piece 19, he then causes the pinion shaft to rise axially and thereby lift the doll above the stage.

Thus the player can concurrently control the speed of the figure skater+s spin and the height to which the skater is elevated above the stage within the limits imposed by the length of the shaft. The player is therefore responsible for the figure skating movement executed by the doll.

The doll is preferably of the type having bendable arms and legs and a bendable neck and torso so that the figure skating doll can be made to assume any desired posture, thereby giving the player still another control over the nature of the figure skating movement.

While there has been shown and described a preferred embodiment of a skating doll platform, it will be appreciated that many changes and modifications may be made therein without, however, departing from the essential spirit thereof.

I claim:

1. A platform and a doll resembling a figure skater, mounted on said platform comprising:

A. a stage,

B. an upright bearing anchored on the stage;

C. a slidable shaft extending through the bearing and coupled at its upper end to a leg of the doll to support the doll above the stage, a lower end of the shaft projecting into a space below the stage; and D. a finger-actuated mechanism disposed in said space operatively coupled to the shaft, said mechanism including first means actuated by a first finger of a player to cause said shaft to rotate and thereby spin the doll, and second means actuated by a second finger of the player to cause the shaft to slide upwardly in said bearing to lift the doll above the stage whereby when the doll concurrently spins and lifts it then stimulating a figure skating movement.

2. A platform as set forth in claim 1, in which said shaft is a pinion shaft, and said first means includes a spin section having a rack which when advanced by a first finger piece actuated by the first finger then engages said pinion shaft through an intermediate gear to rotate said shaft.

3. A platform as set forth in claim 1, in which said second means includes a lift section having a pivoted lever which engages the lower end of the shaft and is caused by a second finger piece actuated by the second finger to swing upwardly to raise the shaft and thereby lift the doll.

4. A platform as set forth in claim 1, in which the upper end of the shaft is joined to a hub having a clamp attached thereto to engage said leg.

5. A platform as set forth in claim 4, in which the clamp is a split shell forming a pair of jaws.

6. A platform as set forth in claim 1, further including a foot rest depending from the clamp to accommodate a foot of the doll.

7. A platform as set forth in claim 6, in which the doll has feet fitted with simulated skates, one of which is received in said foot rest.

* * * * *